United States Patent [19]

Koshelev

[11] 4,031,812

[45] June 28, 1977

[54] HYDRAULIC VIBRATOR FOR ACTUATOR DRIVE

[76] Inventor: Nikolai Vasilievich Koshelev, ulitsa Gagarina, 56, kv. 10, Kuibyshev, U.S.S.R.

[22] Filed: Apr. 19, 1976

[21] Appl. No.: 678,458

Related U.S. Application Data

[63] Continuation-in-part of Ser. No. 449,281, March 8, 1974, abandoned.

[52] U.S. Cl. ..... 91/224; 91/235; 91/277

[51] Int. Cl.[2] ..... F01L 21/04; F01B 7/18

[58] Field of Search ..... 91/224, 225, 235, 277, 91/319

[56] References Cited

UNITED STATES PATENTS

| | | | |
|---|---|---|---|
| 208,449 | 9/1878 | Winchester | 91/225 |
| 384,186 | 6/1888 | Barth | 91/225 |
| 397,166 | 2/1889 | Barth | 91/225 |
| 931,449 | 8/1909 | Mauss | 91/225 |

*Primary Examiner*—Paul E. Maslousky

*Attorney, Agent, or Firm*—Lackenbach, Lilling & Siegel

[57] ABSTRACT

As a drive in metal-cutting machines used for vibration cutting a hydraulic vibrator is proposed, which comprises a differential piston and a spring-balanced slide valve, which are made and arranged so as to ensure reciprocal successive communication between a pressurized chamber and discharge and inlet chambers. In said vibrator the smaller diameter $d$ and the larger diameter D of said piston are in a relation of $d = \sqrt{D^2/2}$, and as a result the piston reciprocates symmetrically with an equal speed in either directions. There is also provided a plurality of compensating chambers controlled by throttles of a variable section. Continuous regulation of the magnitude of the stroke of said differential piston is effected in the hydraulic vibrator over a large range. In such a case a magnitude of the piston's stroke of less than one millimeter can be achieved in addition, the reciprocating displacements of said differential piston will always be smooth and noise-free, the adjustment and control of such parameters as frequency and amplitude of the oscillation during operation are measurably simplified, and symmetrical travel of the piston during operation by simple adjustment and control is possible.

4 Claims, 1 Drawing Figure

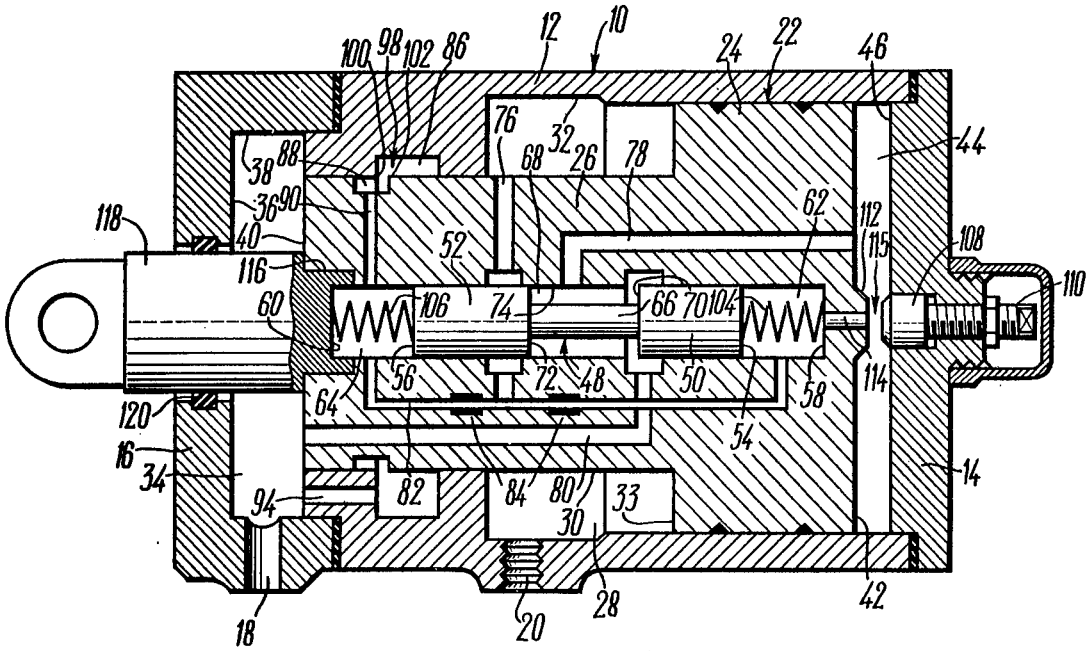
10
12
14
16
18
20
22
24
26
28
30
32
33
34
36
38
40
42
44
46
48
50
52
54
56
58
60
62
64
66
68
70
72
74
76
78
80
82
84
86
88
90
94
98
100
102
104
106
108
110
112
114
115
116
118
120

HYDRAULIC VIBRATOR FOR ACTUATOR DRIVE

DESCRIPTION

The present application is a continuation-in-part of our co-pending application Ser. No. 449,281 for "Hydraulic Vibrator" filed Mar. 8, 1974 and now abandoned.

THE SPHERE OF USE OF THE PRESENT INVENTION

The present invention relates to hydraulic drives of actuators of machines and more particularly to hydraulic vibrators of these drives.

A hydraulic vibrator, according to the present invention, can prove most effective when provided in the drive of actuators of metal-cutting machines used for vibration cutting. The proposed hydraulic vibrator can also be utilized in vibrating conveyers, hopper vibrating feeders and other similar devices.

SHORTCOMINGS OF THE KNOWN HYDRAULIC VIBRATORS

Known in the art are hydraulic for the drives of actuators which comprise a differential piston and a two-plunger slide valve arranged coaxially therein. The piston moves reciprocally in a casing, which puts a pressurized chamber in succession communication with inlet and discharge chambers.

But these hydraulic vibrators have a serious shortcoming. They do not provide a piston stroke of a magnitude of less than 1 millimeter, a function of the hydraulic vibrator which is necessary for the drive of metal-cutting machines. Besides, the frequency of the double strokes of said differential piston depends on a multitude of complicated factors, namely: the amount of fluid medium (as a rule, liquid) being fed into the inlet chamber, its pressure, and the position and adjustability of certain parts, such as adjusting female screws, movable bushes and springs. All these factors combine together to hamper the control of such important parameters of the differential piston as the magnitude of its stroke and the frequency of double strokes.

The characteristic feature of the known hydraulic vibrators is the fact that it is customary to connect the slide valve with the differential piston by means of a ring with a pin mounted therein, said pin being inserted into radial slots of the piston. Such a design does not permit symmetrical displacement of said differential piston. No less serious is the fact that as a result of the piston's impacts against other parts of the hydraulic vibrator, the operation of the vibrator is accompanied by considerable noise, which is detrimental to personnel.

OBJECTS AND SUMMARY OF THE PRESENT INVENTION

The main object of the present invention is to create a hydraulic vibrator for the drive of machines, for example, metal-cutting machines, which would be notable for its smooth and noise free operation.

Another object of the present invention is to create a hydraulic vibrator for the drive of machines, which would be simple in design and at the same time would enable simple adjustment and control of such parameters as the frequency and the magnitude of the stroke of said differential piston.

Still another important object of the invention is to create a hydraulic vibrator for the drive of machines, which would make it possible to obtain a magnitude of the stroke of the differential piston of less than 1 millimeter.

Yet another important object of the invention is to provide a hydraulic vibrator for the drive of machines, wherein the symmetrical displacement of said differential piston with equal speed in either directions is achieved by a special relation between the smaller and larger diameters of said piston.

According to these and other objects, the hydraulic vibrator comprises a differential piston and a spring-balanced slide valve arranged coaxially therein. The piston, in turn, is positioned inside a casing so that it forms, together with said casing, three chambers: a pressurized chamber, an inlet chamber and a discharge chamber. The differential piston reciprocates in the casing, as the spring-balanced slide valve establishes successive communication between the pressurized chamber and said inlet and discharge chambers. The slide valve has several plungers which form, together with the differential piston, additional or compensating chambers. These compensating chambers are intended for communication with the inlet chamber. In addition, one of them is intended for communication with the discharge chamber, and another is extended to communication — with the pressurized chamber.

The hydraulic vibrator comprises throttles of variable section which can interact with the compensating chambers, said chambers are formed by the slide valve's plungers and the differential piston.

One of these throttles is formed by circular superimposed grooves of which one is provided in the casing of said hydraulic vibrator, and another — in the differential piston. Both said grooves have sharp edges. Such a design solution is a conducive to a quick equalizing of the pressure in said compensating chambers.

Another throttle of variable section is formed by a channel, which is arranged in said differential piston and which channel ends in a nozzle and puts one of said compensating chambers in communication with the pressurized chamber, and also by a choke arranged coaxially with the channel and provided with a means to move it along the axis relative to this nozzle. Such a design solution of this throttle ensures easy control of the magnitude of the stroke of said differential piston.

During the delivery of a fluid medium into said inlet chamber the differential piston moves in such a direction that the section of said throttle decreases, while the pressure in one of the compensating chambers increases, thus resulting in displacing the slide valve and in compressing one of its balancing springs. In this case reversal of the differential piston takes place.

The herein-proposed hydraulic vibrator comprises throttles of a constant section, which put the inlet chamber in communication with the compensating chambers and ensure a drop in the pressure so that the pressure in the compensating chambers is less than the pressure in the inlet chamber.

As has been mentioned above, the reciprocating displacement of the differential piston takes place owing to the displacement of the slide valve.

To displace said slide valve a so-called control pressure is needed, said pressure is being produced by a drop in the pressure between the inlet chamber and said compensating chambers with the help of said throttles of constant section.

This control pressure, because of the throttles of constant section, will hold the slide valve in the extreme position until equal pressures are established in the compensating chambers. Then the above-mentioned compressed spring will return the slide valve to a balanced position.

It is preferable that i. the differential piston the smaller diameter $d$ and the larger diameter D be in a relation of $d = \sqrt{D^2/2}$. Thus, as a result, the differential piston has a symmetrical displacement with an equal speed in either direction.

This extends the sphere of use of the hydraulic vibrator.

Further, the hydraulic vibrator for the drive of actuators in metal-cutting machines, embodied according to the invention, has a simple design solution, thus resulting in ensuring continuous control of its main parameters: the magnitude of the stroke of the differential piston and the frequency of its double strokes. That a magnitude of the piston's stroke of less than 1 millimeter is achieved, as has been mentioned above, is especially important in using the hydraulic vibrator as a drive in metal-cutting machines. In addition, the herein-proposed hydraulic vibrator is notable for its smooth and noise-free operation.

BRIEF DESCRIPTION OF THE DRAWING

Other objects and advantages of the hydraulic vibrator for the actuator drive in metal-cutting machines will be more apparent from the following description of an exemplary embodiment of the present invention with references to the accompanying drawing which shows a longitudinal section of the hydraulic vibrator, according to the invention, in which some parts are shown schematically, and others are shown fully or partially by solid lines.

DETAILED DESCRIPTION OF EMBODIMENT

A hydraulic vibrator 10, proposed as an actuator drive, comprises a cylindrical casing 12, ends or covers 14 and 16, and discharge and inlet channels 18 and 20, respectively. The channel 18 can be connected to a drain line (not shown), and the inlet channel 20 —to a force main (also not shown). Said casing 12 houses a differential piston 22 having a portion 24 of a large diameter D and a portion 26 of a smaller diameter $d$.

Said casing 12 and said piston 22 define three chambers. A first or inlet chamber 28 is formed by an external surface 30 of the portion 26 of said piston 22, by an inner surface 32 of said casing 12 and by one of the pressure surfaces 33 of said piston. The inlet chamber 28 is intended for communicating with the force main through the inlet channel 20. A second or discharge chamber 34 is formed by inner surfaces 36 and 38 of the cover 16 and by an end or butt 40 of said piston portion 26 of the smaller diameter. This second or discharge chamber is intended, in particular, for communicating with the drain line through the discharge channel 18.

The other end or butt 42 of the piston 22, which is another pressure surface of the piston portion 24, forms, together with an inner surface 46 of the cover 14, a third or pressurized chamber 44. Arranged coaxially in the piston 22, is a spring-balanced slide valve 48, which comprises cylindrical portions or plungers 50 and 52. Each of said portions 50 and 52 has an end and 56, respectively. Said ends together with opposite surfaces 58 and 60 of said piston form compensating chambers 62 and 64. Positioned between the portions or plungers 50 and 52 of the slide valve 48 is a central cylindrical portion 66. Said portions or plungers form between them a chamber 68, while the smaller diameter of the central portion 66 forms an overlapping surface 70 on the portion 50, and an overlapping surface 72—on the portions 52. These surfaces serve to interact with a wall 74 of the chamber 68 or to overlap it so that, is the position of the spring-balanced slide valve 48 shown in the drawing, the inlet chamber 28 would not communicate with the pressurized chamber 44 through a channel 76, the chamber 68 and a channel 78. But in this position, the discharge chamber 34 communicates with the pressurized chamber 44, through a channel 80, the chamber 68 and the channel 78. Therefore it is understandable that the main function of the spring-balanced slide valve 48 is to provide successive communication between the pressurized chamber 44, the inlet chamber 28 and the discharge chamber 34.

Arranged in the piston 22 is a channel 82 which communicates with the inlet chamber 28 and through the channel 76, and, consequently, also with the inlet channel 20 and the force main. The chambers 62 and 64 are put in communication with each other by the channel 82. Arranged in the channel 82 are several throttles 84 of a constant section, a throttle being positioned on each side of the intersection of said channel 82 with the channel 76. The throttles applied in the given device can be of any suitable design, provided that they can be set beforehand at a predetermined and necessary value.

Thus, it can be seen that through the throttles 84 of constant section and the channel 82 the compensating chambers 62 and 64 communicate with each other, and through the channel 76 they also communicate with the inlet channel 20 and the inlet chamber 28. This connection, as it will become evident later, is very important if, as we remember, it is necessary to achieve successive communication of the pressurized chamber 44 with the inlet chamber 28 and then with the discharge chamber 34.

Arranged in the casing 12 is a circular groove 86, and chamber 64 can communicate through a channel 90 with the discharge chamber 34 and, hence, via a channel 94 provided in the casing 12, through the discharge channel 18—with the drain line.

Said circular superimposed grooves 86 and 88 form a throttle 98 of variable section. The grooves 86 and 88 have sharp edges 100 and 102, respectively. The edges 100 and 102 easily cut disrupt communication between the chamber 64 and the discharge channel 18 through the channel 90, the groove 88, the groove 86, the channel 94 and the chamber 34. As a result, the pressures in the chambers 62 and 64 equalize without delay.

Arranged in the chamber 62 is a spring 104, and in the chamber 64—a spring 106. These springs serve to balance the slide valve 48 and to hold it the position clearly illustrated in the drawing. In this balanced position of the slide valve, the inlet chamber 28 does not communicate with the pressurized chamber 44, and, hence, the inlet channel 20 does not communicate with the pressurized chamber. But, as has been mentioned above, the pressurized chamber 44 communicates with the discharge chamber 34 and, hence, with the drain line through the discharge channel 18.

Secured on a screw 110 is a choke 108. The screw is arranged in said cover 14 so that, by turning it, it is possible to change the position of the choke 108 relative to the pressure surface on the end 42 of the piston portion 24 of the larger diameter. This pressure surface comprises a nozzle 112 through which a channel 114 passes. The choke 108 is positioned coaxially with the nozzle 112 and is regulated relative to said nozzle by being displaced along its axis.

The channel 114, said nozzle 112 and the choke 108 together make up a throttle 115 of variable section of the "nozzle-choke" type. Moreover, the channel 114 provides communication between the chamber 62 and the pressurized chamber 44. Consequently, the throttle 115 does not control the liquid flow, but serves to raise the pressure in said compensating chamber 62, when said differential piston 22 is in the extreme right (according to the drawing) position. Said throttle 115 also regulates the magnitude of the stroke of said differential piston 22.

In the end 40 of the piston 26 of the smaller diameter there is provided a hole 116 which has rigidly mounted in it a drive connector 118. Said connector serves to connect the hydraulic vibrator with the actuator of such metal-cutting machines as grinding, honing and similar ones. The cover 16 comprises an appropriate sealing 120 the purpose of which is evident to those skilled in the art to which the invention pertains.

It is desirable that the stroke of the differential piston 22 to the right and to the left (see in the drawing) be symmetrical and its speed in either directions be equal. That is, the speed of the stroke in each direction would be preferably the same. It has been found out, that this can be achieved when the smaller diameter $d$ of the piston portion 26 and the larger diameter D of the portion 24 are in a relation of $d = \sqrt{D^2/2}$.

The hydraulic vibrator functions as follows.

When the spring-balanced slide valve 48 is in a balanced or initial position, which is shown in the drawing, its plunger 52 overlaps, blocks or closes the channel 76, thereby preventing the inlet chamber 28 from communicating with the pressurized chamber 44 through the channel 76, the chamber 68 and the channel 78. However, through the channel 78, the chamber 68 and the channel 80 the pressurized chamber 44 communicates with the discharge chamber 34. Consequently, discharge from said pressurized chamber 44 of any fluid medium which is therein will be effected through the discharge chamber 34 and the discharge channel 18.

The throttles 84 of constant section are positioned so that a considerable drop in the pressure is produced between the portion wherein the channel 76 intersects the channel 82 and the other side of each of said throttles. When being fed into the inlet chamber 28 and through the channels 76 and 82, respectively, the fluid medium flows into the chambers 62 and 64, respectively. But because of the drop in the pressure produced by the throttles 84 of constant section, the resultant pressure in these chambers will be substantially less than the fluid medium pressure in the inlet chamber 28. From the chamber 62 and from the pressurized chamber 44 the fluid medium flows into the drain line through the channel 78, the chamber 68, the channel 80, the discharge chamber 34 and the discharge channel 18. Consequently, the pressure in the inlet chamber 28 will be higher than that in the pressurized chamber 44, and, as a result of the fact that this pressure acts on the pressure surface 33 of the piston portion 24 of the larger diameter, which surface 33 faces the chamber 28, the piston 22 starts moving to the right in the drawing.

The travel of said piston 22 continues until said throttle 115 begins to be overlapped, thus facilitating the forcing of the pressure in the compensating chamber 62. When the nozzle 112 and the choke 108 draw near enough so that a sufficient pressure is created or forced in said chamber 62, the slide valve 48 starts moving to the left in the drawing, compressing the spring 106. The plunger 50 closes or overlaps the channel 80, thus stopping communication between the pressurized chamber 44 and the discharge chamber 34. By opening at this moment the channel 76 the plunger 52 establishes communication between the inlet chamber 28 and the pressurized chamber 44 through the chamber 68 and the channel 78. Consequently, the fluid medium pressure in the pressurized chamber 44 will increase until it reaches a magnitude essentially equal to the fluid medium pressure in the inlet chamber 28.

It is to be remembered that the throttles 84 of constant section are set beforehand to create a predetermined drop in the pressure. Until said piston 22 is displaced to the right and the slide valve 48 –to the left, the fluid medium flows from the chamber 62, through the channel 114, into the pressurized chamber 44, the channel 78, the chamber 68, the channel 80, the discharge chamber 34 and the discharge channel 18 into the drain line. From the chamber 64 the fluid medium flows into the drain line through the channel 90, the grooves 88 and 86, i.e., the throttle 98 of variable section, the channel 94, the discharge chamber 34 and the channel 18.

The discharge of said fluid medium from the chamber 62 does not stop all of a sudden. It stops gradually, as the nozzle 112 and the choke 108 draw nearer, and the discharge of said fluid medium stops finally when the pressure in the chamber 62 increases so that the plunger 50 of the slide valve, being displaced to the left, overlaps the channel 80.

Returning now to that moment in the operation of the described vibrator at which the pressures in the chambers 28 and 44 are essentially equal, the difference in the areas of the pressure surfaces 33 and 42 of the piston portion 24 of the larger diameter forces the piston 22 to move to the left in the drawing. As a result of such displacement, the casing 12 closes or overlaps the circular groove 88 at the sharp edges 100 and 102, thereby cutting off the groove 88 from the groove 86 of said throttle 98. Thus, the channel 90 through which the fluid medium is discharged from the chamber 64 is cut off from the channel 94, the discharge chamber 34 and the discharge channel 18.

The pressures in the chambers 62 and 64 immediately equalize, because, as has been mentioned above, said edges 100 and 102 easily break and then preclude communication between the grooves 88 and 86, and, hence, between the channels 90 and 94. As soon as these pressures are equalized, the formerly compressed spring 106, which is arranged in the chamber 64 and the force of which at a given moment surpasses the force of the spring 104 arranged in the chamber 62, displaces the slide valve 48 to the right in the drawing until it returns to its balanced or initial position. This position, as has been afore-mentioned, is the position which is shown in the drawing. The plunger 52 closes the channel 76, while the plunger 50 opens the channel 80. The discharge of the fluid medium from the pressurized chamber 44 again starts, which discharge produces a pressure differential between the pressure surfaces 33 and 42 of the piston portion 24 of the larger diameter. Under the action of a higher pressure exerted on the pressure surface 33, which surface faces the inlet chamber 28, the piston 22 starts moving to the right and continues moving until the just described cycle is fully completed and begins to repeat itself again.

The reciprocating cyle of said differential piston of the described vibrator will be continuously repeated, as long as the supply of the fluid medium under pressure continues to be supplied to the inlet chamber 28 through the force main and the inlet channel 20.

The frequency of the double strokes of the piston 22 can be controlled by simply increasing or decreasing the amount of the fluid medium being supplied into the inlet chamber 28. The magnitude of the piston's stroke can be varied from zero to any preset magnitude by simply changing the position of the choke 108 of said throttle 115 relative to the nozzle 112. Especially important here is the fact that the magnitude of the piston's stroke can be reduced to a magnitude which is less than 1 millimeter. In spite of achieving such important advantages and improvements, the vibrator, according to the invention, will always be smooth and noise-free during operation.

Though the present invention, with a view to understanding it more clearly, was shown and, to some extent, described in detail on an exemplary embodiment, it is understandable that it allows certain changes and modifications, not exceeding the limits of the claim.

What is claimed is:

1. A hydraulic vibrator for the drive of actuators in metal-cutting machines, comprising: a casing; a differential piston arranged in said casing and moving reciprocally therein, said differential piston having a first pressure surface and a second pressure surface, the second pressure surface of the piston being larger than the first pressure surface; a spring-balanced slide valve having a plurality of plungers which are arranged coaxially in said differential piston and which move reciprocally therein; said differential piston and said casing being positioned so that they define at least one inlet chamber, one pressurized chamber and one discharge chamber, said inlet chamber being defined at least partially by the first pressure surface of said piston and by said casing, said pressurized chamber being defined by the second pressure surface of said piston and at least partially by said casing, and said discharge chamber being defined at least partially by said casing and by an end of said piston; said spring-balanced slide valve ensuring successive communication of said pressurized chamber with said discharge and inlet chambers; said slide valve defines by its plungers, together with said piston, a plurality of compensating chambers; throttles of constant section providing communication between said inlet chamber and said compensating chambers, said throttles of constant section ensuring a drop in the pressure, as a result of which the pressure in the compensating chambers is less than the pressure in the inlet chamber; and throttles of variable section controlling communication between the compensating chambers and said discharge chamber; whereby said differential piston performs reciprocating displacements smoothly and noiselessly.

2. A hydraulic vibrator according to claim 1, wherein one of said throttles of variable section is formed by circular superimposed grooves, one of said grooves being provided in said casing and another in said differential piston; said grooves have sharp edges owing to which, in the process of reciprocating movement of said piston, communication between the compensating chambers and said discharge chamber is disrupted, and the pressure in the compensating chambers equalizes, whereby said slide valve returns to a balanced position.

3. A hydraulic vibrator according to claim 2, wherein another throttle of variable section is formed by a channel provided in said differential piston, said channel ending in a nozzle and providing communication between one of the compensating chambers and said pressurized chamber, and by a choke arranged coaxially with the channel, said choke being provided with a means for moving it along the axis relative to this nozzle; whereby, as a result of displacement of the choke, stepless control of the magnitude of the stroke of said differential piston is effected.

4. A hydraulic vibrator according to claim 1, wherein the diameter of said first pressure surface of said differential piston is determined from the following relation:

$$d = \sqrt{D^2/2}$$

, where $d$ is the diameter of said first pressure surface of said piston, and $d$ is the diameter of said second pressure surface of said piston, whereby as a result the differential piston reciprocates symmetrically with an equal speed in either direction.

* * * * *